US007803026B2

(12) United States Patent
McKinney

(10) Patent No.: US 7,803,026 B2
(45) Date of Patent: Sep. 28, 2010

(54) MARINE ENGINE EXHAUST SYSTEM

(75) Inventor: Mark C. McKinney, Irmo, SC (US)

(73) Assignee: Pleasurecraft Marine Engine Co., Little Mountain, SC (US)

( * ) Notice: Subject to any disclaimer, the term of this patent is extended or adjusted under 35 U.S.C. 154(b) by 238 days.

(21) Appl. No.: 11/729,671

(22) Filed: Mar. 29, 2007

(65) Prior Publication Data

US 2008/0242164 A1 Oct. 2, 2008

(51) Int. Cl.
*B63H 21/32* (2006.01)

(52) U.S. Cl. ..... 440/89 R; 440/89 B

(58) Field of Classification Search ..... 440/89 R, 440/88 G, 88 J, 89 B, 89 C; 60/310, 320; 181/235; 123/41.3, 41.31
See application file for complete search history.

(56) References Cited

U.S. PATENT DOCUMENTS

| | | | | |
|---|---|---|---|---|
| 1,824,736 | A | 9/1931 | Johnson et al. | |
| 3,206,836 | A * | 9/1965 | Schlussler | 29/890.08 |
| 4,504,238 | A * | 3/1985 | Neisen | 440/89 B |
| 4,573,318 | A | 3/1986 | Entringer et al. | |
| 4,687,450 | A | 8/1987 | Bland et al. | |
| 4,734,071 | A | 3/1988 | Zemlicka et al. | |
| 4,759,181 | A | 7/1988 | Biritz | |
| 4,801,283 | A | 1/1989 | Ruhnke | |
| 4,831,822 | A | 5/1989 | Yoshimura | |
| 4,845,945 | A | 7/1989 | Widmer et al. | |
| 4,977,741 | A | 12/1990 | Lulloff et al. | |
| 4,997,399 | A | 3/1991 | Nakayasu et al. | |
| 5,109,668 | A | 5/1992 | Lindstedt | |
| 5,531,620 | A | 7/1996 | Ozawa et al. | |
| 5,820,426 | A | 10/1998 | Hale | |
| 6,022,254 | A * | 2/2000 | Neisen | 440/89 R |
| 6,030,263 | A | 2/2000 | Uchino et al. | |
| 6,120,335 | A | 9/2000 | Nakase et al. | |
| 6,183,324 | B1 | 2/2001 | Nanami | |
| 6,290,558 | B1 | 9/2001 | Erickson | |
| 6,412,595 | B1 | 7/2002 | Horak et al. | |
| 6,454,622 | B2 | 9/2002 | Mashiko et al. | |
| 6,511,355 | B1 | 1/2003 | Woodward | |
| 6,582,263 | B1 | 6/2003 | Jaeger et al. | |

(Continued)

OTHER PUBLICATIONS

U.S. Appl. No. 11/893,023; titled "Marine Engine Exhaust System with Cooling Arrangement"; Inventor: Mark C. McKinney; filed Aug. 14, 2007; (36 pages).

(Continued)

*Primary Examiner*—Ed Swinehart
(74) *Attorney, Agent, or Firm*—J. Bennett Mullinax, LLC

(57) ABSTRACT

A marine engine exhaust system is provided. One exemplary embodiment of the system includes first and second manifolds. A first gas is transferred through a first conduit from the first manifold and is isolated from cooling water through at least a portion of the first conduit. A second conduit is in fluid communication with the second manifold and allows a second gas to be transferred through that is isolated from cooling water through a portion of its length. The first and second conduits are in fluid communication with a third conduit in which the first and second gases merge. Cooling water is merged with either the first or second gas, or both, in the first and second conduits before the first gas and second gas merge in the third conduit.

23 Claims, 10 Drawing Sheets

U.S. PATENT DOCUMENTS

| | | | |
|---|---|---|---|
| 6,638,124 | B2 | 10/2003 | Zoubul et al. |
| 6,644,024 | B1 | 11/2003 | Powers et al. |
| 6,672,919 | B1 | 1/2004 | Beson |
| 6,764,361 | B1 | 7/2004 | Matsuda |
| 6,800,004 | B1 | 10/2004 | White et al. |
| 6,802,750 | B2 | 10/2004 | Hellmann |
| 6,929,520 | B1 | 8/2005 | Hughes et al. |
| 7,314,044 | B2 | 1/2008 | Westerbeke |
| 2004/0035100 | A1 | 2/2004 | Westerbeke et al. |
| 2004/0063364 | A1 | 4/2004 | Matsuda |
| 2005/0120705 | A1 | 6/2005 | Westerbeke, Jr. |

OTHER PUBLICATIONS

Indmar, Web site print outs from www.indmar.com for Indmar Introduces First Production Catalyst For Inboard Engines, visited Oct. 2, 2006, (3 pages).

Malibu Boats, Web site print outs from www.malibuboats.com for BalibuBoats 2007, visited Oct. 17, 2006, (2 pages).

United States Office Action issued in U.S. Appl. No. 11/893,023; titled "United States Office Action"; Author Lars A. Olson; mailed on Dec. 11, 2008; (7 pages).

* cited by examiner

MARINE ENGINE EXHAUST SYSTEM

FIELD OF THE INVENTION

The present invention relates generally to an exhaust system for an inboard marine engine. More particularly, the present application involves a marine engine exhaust system for use with a twin head engine that has a crossover portion through which exhaust gases are channeled.

BACKGROUND

Marine engines used to power watercraft, such as a boat, are susceptible to being damaged through introduction of water. Water injection can occur in a marine engine in several different manners. Although four such manners will be discussed it is to be understood that other types are possible. The first means is through wave action. Here, a surge of water enters the exhaust track and proceeds into the engine. The surge of water is produced from an external source such as the wake of a passing boat, inclement weather or turning of the watercraft. The second way in which water can be introduced into the marine engine is through by-products of the combustion process. Marine engines have exhaust manifolds that operate at a lower temperature than land based engines due to the fact the engine must be safely designed in order to be enclosed in a watercraft. The aforementioned means of water injection can be controlled through proper design elements in the marine engine manifold, calibration of the marine engine, and through proper operation and maintenance of the watercraft.

A third way of introducing water into the marine engine is by way of condensation. Condensation may occur through having dissimilar cooling rates of various components subsequent to shutting down the engine. Temperature differences between daytime and nighttime may also cause condensation to form in the engine exhaust system. Further, condensation may also result from having too low of an operating temperature of the exhaust system. Condensation can be controlled through design of all of the components of the exhaust system. In this manner, an elbow of the manifold, exhaust angle and exhaust hoses can be designed and selected to minimize or eliminate the occurrence of condensation in the system.

The fourth way through which water may be introduced into a marine engine is through reversion. This manner of water injection is the hardest to control. Reversion is the backwards flow of exhaust gases during the time period in which both intake and exhaust valves are simultaneously open. Pulses in the exhaust system cause water to work its way backward into the exhaust manifold. Reversion primarily occurs when the engine runs at idle speed or slightly above idle speed. Reversion can be controlled through manifold design and operating temperature. Further, engine calibration and certain camshaft designs can be used to reduce reversion in marine engine exhaust systems.

Water injected into such an engine typically damages an exhaust valve thus preventing the cylinder with the damaged exhaust valve from correctly sealing. This damaged cylinder then causes water to be pulled into the engine through the corrupted exhaust valve. This water is redistributed to the rest of the engine and causes its ultimate failure. The control of water injection is a primary objective of watercraft and engine manufacturers and is especially challenging considering the environment into which the watercraft is deployed.

One known type of marine engine exhaust system design that seeks to minimize reversion employs connected conduits from a pair of manifolds on either side of the engine. Gas pulses from each conduit are combined and are subsequently injected with cooling water. This type of system seeks to combine pulses from either side of the engine so that double the number of pulses are present during engine idle. Unfortunately, the exhaust gases in such a system are extremely hot because water is not added until some point after the gases combine. This arrangement increases backpressure on the engine.

Over the years, marine engine exhaust systems have been proposed to minimize water reversion as well as the other three conditions capable of causing water ingestion. Although current systems have achieved some degree of success, no classically designed system exists that is capable of completely eliminating all means of water entry into a marine engine. As such, there remains room for variation and improvement within the art.

SUMMARY

Various features and advantages of the invention will be set forth in part in the following description, or may be obvious from the description, or may be learned from practice of the invention.

One aspect of one exemplary embodiment provides for a marine engine exhaust system that includes first and second manifolds. A first corner is in fluid communication with the first manifold so that a first gas exiting the first manifold is transferred into the first corner. The first gas is isolated from cooling water at least part way through the first corner. A second corner is in fluid communication with the second manifold so that a second gas exiting the second manifold is transferred into the second corner. The second gas is isolated from cooling water at least part way through the second corner. A crossover is in fluid communication with the first corner and second corner so that the first gas exiting the first corner is transferred into the crossover and so that the second gas exiting the second corner is transferred into the crossover. The crossover is configured so that the first gas and the second gas merge therein. The cooling water is merged with at least one of the first gas and the second gas before the first gas and the second gas merge in the crossover.

Another aspect of one exemplary embodiment exists in a marine engine exhaust system as immediately discussed in which cooling water is merged with the first gas and with the second gas before the first gas and the second gas merge in the crossover.

A further aspect of an additional embodiment resides in a marine engine exhaust system in which cooling water is injected in a mist form when merged with at least one of the first gas and the second gas before the first gas and the second gas merge in the crossover.

An additional aspect of an exemplary embodiment is found in a marine engine exhaust system as previously mentioned in which the first manifold has a first catalyst for treating the first gas. The second manifold also has a second catalyst for treating the second gas.

Another aspect of an exemplary embodiment resides in a marine engine exhaust system as mentioned above in which the first corner and second corner are oriented so that the first gas and the second gas flow downward in the downstream direction from the first manifold and second manifold to the crossover. The crossover is arranged at a low point for retaining condensation.

One aspect of an exemplary embodiment of a marine engine exhaust system includes a first manifold in fluid communication with a first corner so that a first gas exiting the first manifold is transferred into the first corner. The first gas is isolated from cooling water through the first corner. A second manifold is present and is in fluid communication with a second corner so that a second gas exiting the second manifold is transferred into the second corner. The second gas is isolated from cooling water through the second corner. A crossover is in fluid communication with the first corner and second corner so that the first gas exiting the first corner is transferred into the crossover and so that the second gas exiting the second corner is transferred into the crossover. The crossover is configured so that the first gas and the second gas are maintained separate therethrough. An elbow is in fluid communication with the crossover so that the first gas exiting the crossover is transferred into the elbow and so that the second gas exiting the crossover is transferred into the elbow. The elbow is configured to allow the first gas and the second gas to merge with one another. Cooling water is merged with at least one of the first gas and the second gas before the first gas and the second gas merge in the elbow.

Another aspect of one embodiment is found in a marine engine exhaust system in which cooling water is merged with the first gas and with the second gas before the first gas and the second gas merge in the elbow.

A further aspect of another exemplary embodiment resides in a marine engine exhaust system as immediately discussed in which the elbow has a wall that keeps the first gas and the second gas separate through a majority of the transfer length through the elbow. The merged first gas and cooling water is merged with the merged second gas and cooling water at a tip of the elbow.

Another exemplary embodiment is found in a marine engine exhaust system as previously described in which the first manifold has a first catalyst for treating the first gas. The second manifold has a second catalyst for treating the second gas.

An additional aspect of an exemplary embodiment exists in a marine engine exhaust system as previously described in which the first corner and second corner are oriented so that the first gas and the second gas flow downward in the downstream direction from the first manifold and second manifold to the crossover. The elbow is oriented with respect to the crossover so that the first gas and the second gas flow upwards in the downstream direction from the crossover into the elbow through an elbow inlet. The crossover is at a low point for retaining condensation.

An additional aspect of one exemplary embodiment is a marine engine exhaust system that includes a first manifold and second manifold. A first conduit is in fluid communication with the first manifold so that a first gas exiting the first manifold is transferred into the first conduit. The first gas is isolated from cooling water through at least a portion of the first conduit. A second conduit is in fluid communication with the second manifold so that a second gas exiting the second manifold is transferred into the second conduit. The second gas is isolated from cooling water through at least a portion of the second conduit. A third conduit is in fluid communication with the first conduit and second conduit so that the first gas exiting the first conduit and the second gas exiting the second conduit merge in the third conduit. Cooling water is merged with at least one of the first gas in the first conduit and the second gas in the second conduit before the first gas and the second gas merge in the third conduit.

Another aspect of an exemplary embodiment is found in a marine engine exhaust system in which cooling water is merged with the first gas in the first conduit and cooling water is merged with the second gas in the second conduit before the first gas and the second gas merge in the third conduit.

An additional exemplary embodiment includes an aspect in which a marine engine exhaust system as previously mentioned injects cooling water in a mist form when merged with at least one of the first gas and the second gas before the first gas and the second gas merge in the third conduit.

Another exemplary embodiment of one aspect is a marine engine exhaust system that has a first manifold and a second manifold. A first conduit is in fluid communication with the first manifold so that a first gas exiting the first manifold is transferred into the first conduit. At least a portion of the first conduit is located in a crossover. A second conduit is in fluid communication with the second manifold so that a second gas exiting the second manifold is transferred into the second conduit. At least a portion of the second conduit is located in the crossover. A third conduit is in fluid communication with the first conduit and second conduit so that the first gas exiting the first conduit and the second gas exiting the second conduit merge in the third conduit. The first conduit and second conduit are oriented such that the first gas and the second gas flow downward from the first manifold and the second manifold in the downstream direction to the crossover. The crossover is at a low point for retaining condensation.

Another aspect of one exemplary embodiment of the marine engine exhaust system is provided as above in which cooling water is merged with at least one of the first gas in the first conduit and the second gas in the second conduit before the first gas and the second gas merge in the third conduit. The first gas is isolated from cooling water through at least a portion of the first conduit. The second gas is isolated from cooling water through at least a portion of the second conduit.

An additional aspect of another exemplary embodiment of the marine engine exhaust system resides as above in which the first manifold has a first catalyst for treating the first gas. The second manifold has a second catalyst for treating the second gas.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
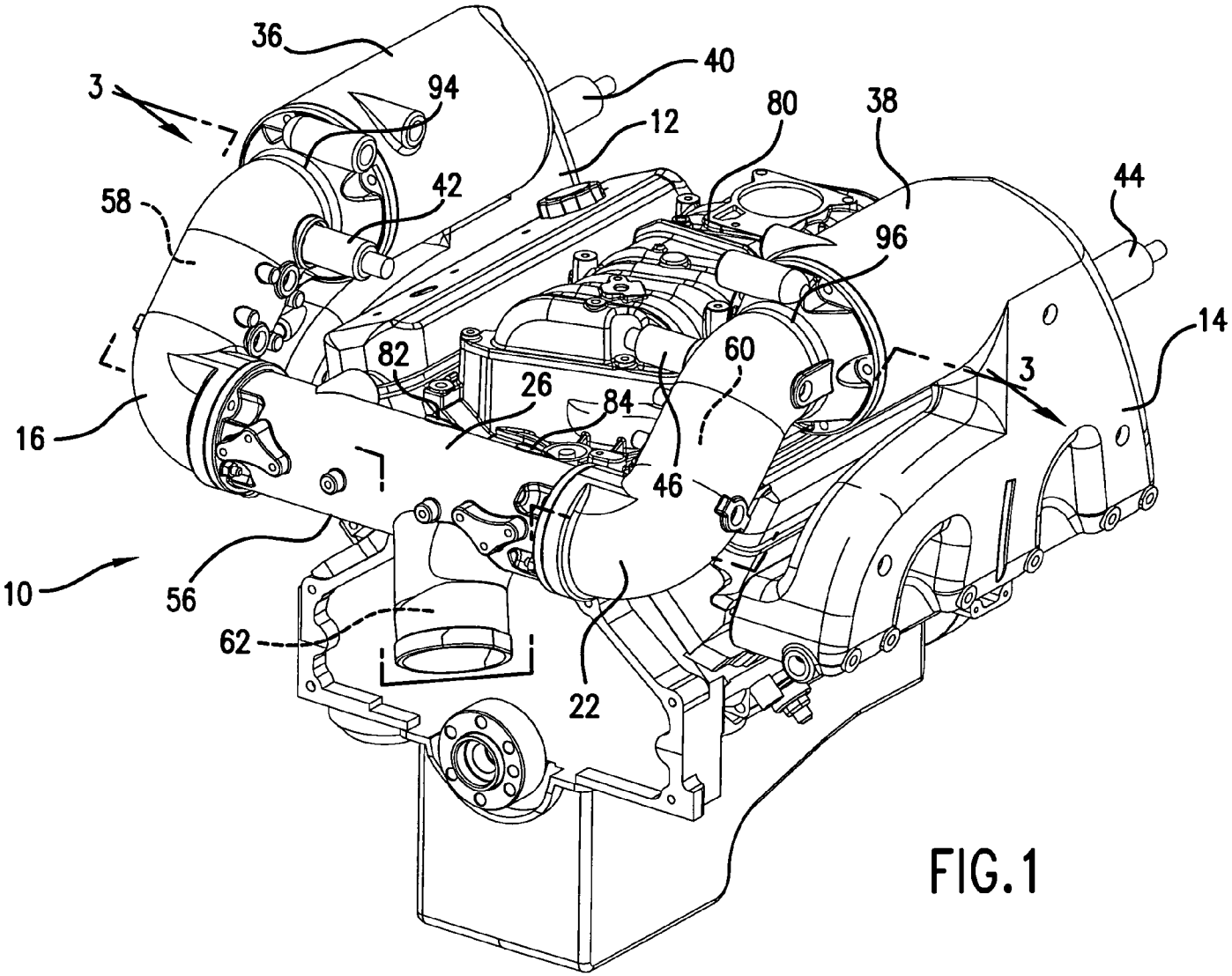
FIG. 1 is a perspective view of a marine engine exhaust system in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a marine engine exhaust system 10 that can be used on a twin head inboard engine 80 in a watercraft. The marine engine exhaust system 10 may include a pair of conduits 58 and 60 extending from a pair of manifolds 12 and 14 of the engine 80 through which exhaust gases 18 and 24 are transferred. Cooling water 28 and 30 can be added to the exhaust gases 18 and 24 before the gases 18 and 24 are combined with one another and transferred through a third conduit 62 and out of the watercraft. Such an arrangement helps reduce backpressure in the system 10 and helps eliminate reversion due to the length and arrangement of the conduits 58 and 60. In accordance with certain exemplary embodiments, the marine engine exhaust system 10 can be arranged so that the conduits 58 and 60 channel the exhaust gases 18 and 24 downward to a low point 56. Condensation forming in the marine engine exhaust system 10 may accumulate at the low point 56 and be prevented from regressing back into and damaging engine 80.

FIG. 1 shows a marine engine exhaust system 10 in accordance with one exemplary embodiment of the present invention. The marine engine exhaust system 10 is shown being used in conjunction with an engine 80 that is an eight cylinder twin head marine engine. It is to be understood, however, that other exemplary embodiments exist in which the engine 80 may be variously configured. A first manifold 12 is located on one side of the engine 80 and is in communication with the cylinders of the engine 80 located on this side. The first manifold 12 is used to transport exhaust gas from the engine 80 and typically includes internal features, such as runners, that are used to more easily channel the gas from the individual cylinders to a single stream. The manifold 12 may also include additional internal features, such as damns, that act to catch water and prevent it from regressing back into and damaging the engine 80.

The first manifold 12 may include a first catalyst 36 in accordance with certain exemplary embodiments of the present invention. The first catalyst 36 functions so as to reduce pollutants in a first gas 18 passing therethrough from the engine 80. An oxygen sensor 40 may be included in the first manifold 12 and positioned so as to acquire data regarding the first gas 18 before entering the first catalyst 36. An additional oxygen sensor 42 is located after the first catalyst 36 and monitors the first gas 18 exiting therefrom. The functionality of the first catalyst 36 can be monitored and information retrieved can be used to modify the running of engine 80 or other components of the watercraft. The first catalyst 36 can be of any type used with engine exhaust systems. Typically, the first catalyst 36 works best if the first gas 18 is both hot and dry. In fact, water may damage the first catalyst 36, oxygen sensor 40 and oxygen sensor 42 in certain embodiments thus making water control at this portion of the marine engine exhaust system 10 desirable.

A second manifold 14 is located on the side of engine 80 opposite that of the first manifold 12. The second manifold 14 receives exhaust gases from the cylinders located on the side of engine 80 opposite the first manifold 12. The second manifold 14 may be provided in a manner similar to the first manifold 12 as previously discussed and a repeat of the features and functionality is not necessary. Additionally, a second catalyst 38 can be provided in order to treat a second gas 24 transferred from the second manifold 14. The second catalyst 38 along with oxygen sensors 44 and 46 can be provided as previously discussed with respect to the first catalyst 36 and oxygen sensors 40 and 42 and repeating their features and functionality is likewise not necessary. Although described as employing catalysts 36 and 38, it is to be understood that other embodiments of the present system 10 are possible in which either one of or both of the catalysts 36 and 38 and associated oxygen sensors 40, 42, 44 and 46 are not present. Further, catalyst 36 may be made of different materials or may have a construction different than catalyst 38 in accordance with certain exemplary embodiments.

Figure 2:
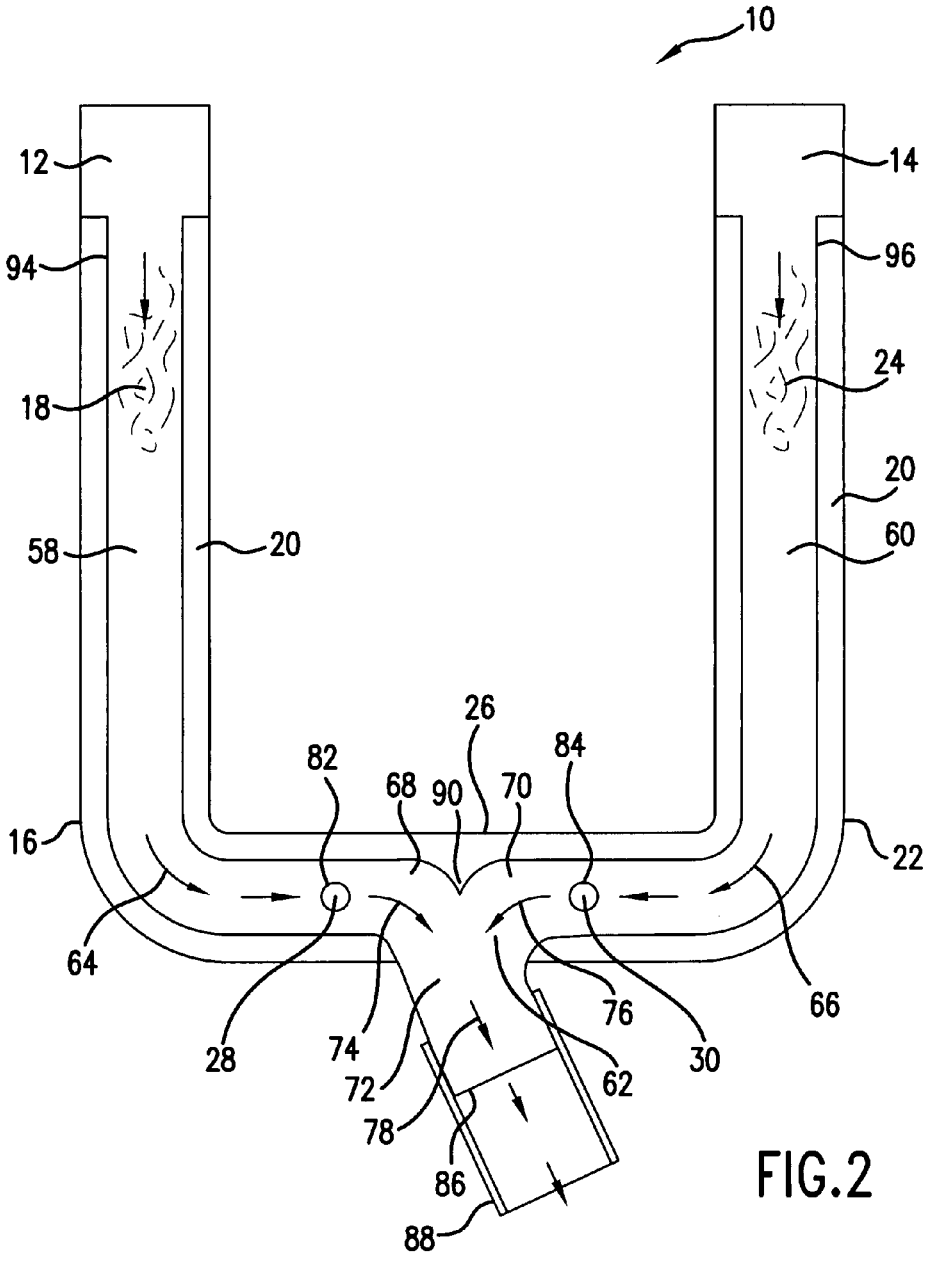
FIG. 2 is a schematic circuit view of the marine engine exhaust system of FIG. 1.

A schematic view of the marine engine exhaust system 10 of FIG. 1 is shown in FIG. 2. The first and second manifolds 12 and 14 function so as to transport the first gas 18 and second gas 24 therefrom without the presence of cooling water mixed with the gases 18 and 24. The first gas 18 is transferred from the first manifold 12 into a first conduit 58. In a similar fashion, the second gas 24 is transferred from the second manifold 14 into a second conduit 60. The first conduit 58 and second conduit 60 may be defined in a first corner 16 and second corner 22, respectively, in accordance with one embodiment of the present invention. The first conduit 58 and second conduit 60 are in fluid communication with a third conduit 62. The third conduit 62 may be located in a crossover 26 that is connected to an end of the first corner 16 and second corner 22. The first gas 18 can exit the first conduit 58 of the first corner 16 and enter the third conduit 62 of the crossover 26 in the downstream direction of flow 64. The second gas 24 in second conduit 60 of the second corner 22 can also exit therefrom into the third conduit 62 of the crossover 26 in the downstream direction of flow 66.

Figure 3:
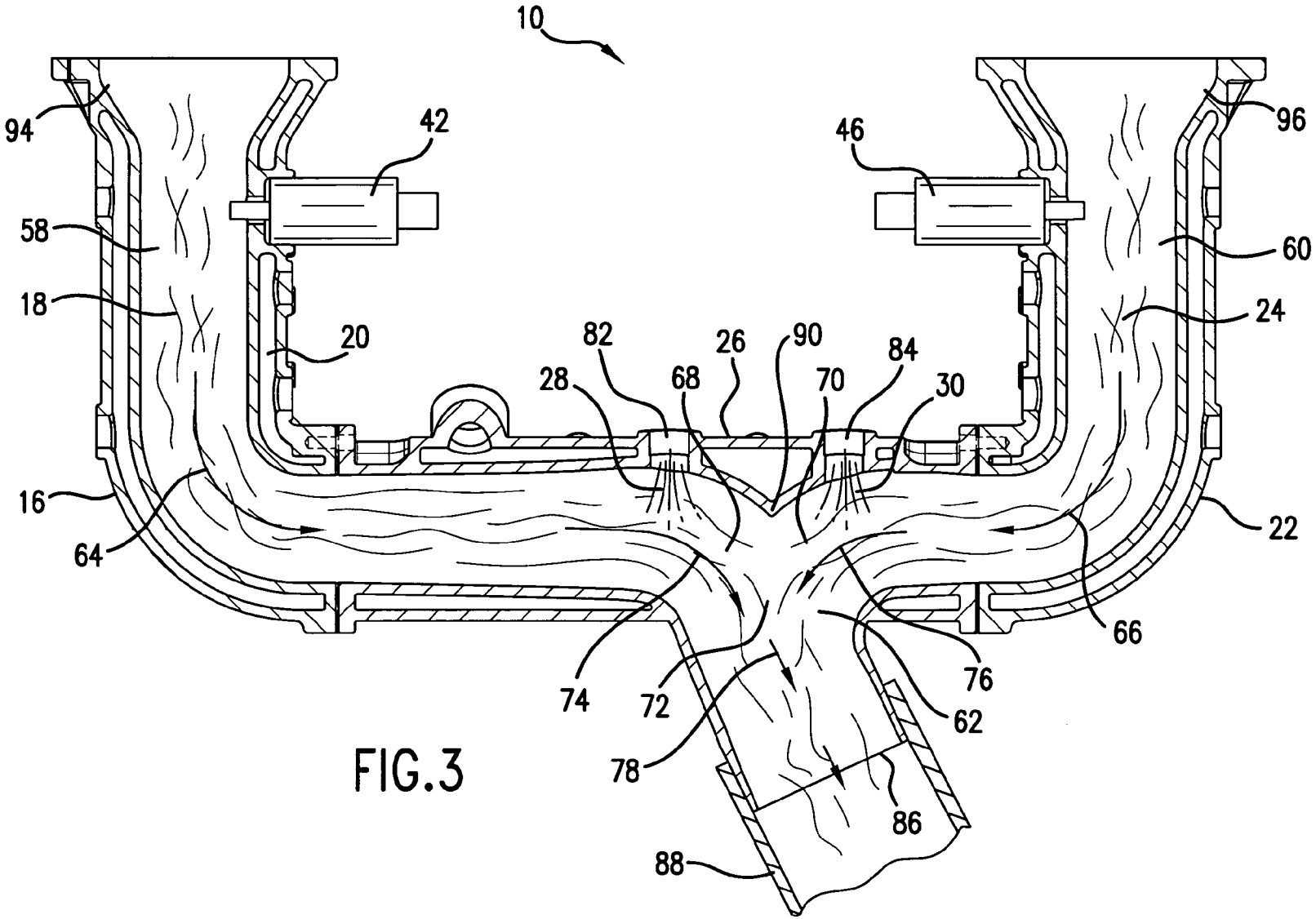
FIG. 3 is a cross-sectional view showing the corners and crossover of the marine engine exhaust system of FIG. 1.

As the first gas 18 and second gas 24 are hot exiting the cylinders of the engine 80, cooling fluid 20 is present in order to cool various components of the marine engine exhaust system 10. The cooling fluid 20 may be channeled through the first and second manifolds 12 and 14 but kept separate from the first and second gases 18 and 24 in order to cool these components. In a similar manner, cooling fluid 20 can be channeled through the corners 16 and 22 and crossover 26 in order to provide cooling. Here, the conduits 58, 60 and 62 may be jacketed such that cooling fluid 20 substantially surrounds the conduits 58, 60 and 62 on all sides. The jacketing of the corners 16 and 22 and the crossover 26 may be better shown with reference to the cross-sectional view in FIG. 3. The cooling fluid 20 can be water or may be antifreeze in accordance with certain exemplary embodiments. When antifreeze is used, a heat exchanger is employed in order to transfer heat from the antifreeze into cooling water that is warmed and then subsequently disposed through the marine engine exhaust system 10.

Inlets 82 and 84 are present in the crossover 26. Cooling water 28 can be injected through inlet 82 and merged with the first gas 18 in the third conduit 62. This creates a combined stream 68 which has a direction of flow 74. Cooling water 30 can be injected through inlet 84 and merged with the second gas 24 in third conduit 62. Injection of cooling water 30 at this point creates a combined stream 70 that has a direction of flow 76. Combined stream 68 and combined stream 70 may then merge with one another in the third conduit 62 in order to form a resulting combined stream 72 that has a direction of flow 78. A channeling member 90 may be present in the crossover 26 in order to allow the combined streams 68 and 70 to more easily merge into the combined stream 72. With this arrangement, cooling water 28 and 30 can be added to the first gas 18 and second gas 24 before the first gas 18 and second gas 24 merge with one another. The combined cooling water 28 and 30 and exhaust gases 18 and 24 can be dispensed through an outlet 86 of the crossover 26 and into a hose 88. From here, the combined stream 72 can be transferred to any desired location. For example, the combined stream 72 may be transferred through hose 88 and into the body of water over the stern of the watercraft.

Addition of cooling water 28 and 30 to the first gas 18 and second gas 24 prior to the gases 18 and 24 mixing acts to cool and contract the exhaust gases 18 and 24. This action helps reduce the exhaust backpressure which enhances engine performance and promotes improved space savings as the ability to reduce the exhaust track size is achieved. However, it is to be understood that other embodiments of the present invention exist in which cooling water 28 is added to the first gas 18 and cooling water 30 is not added to the second gas 24 prior to the gases 18 and 24 merging with one another. Similarly, embodiments exist in which cooling water 30 is added to the second gas 24 but cooling water 28 is not added to the first gas 18 prior to mixing of the gases 18 and 24. The inlets 82 and 84 need not be located in the crossover 26. In this regard, inlet 82 may be located in the first corner 16 and inlet 84 may be located in the second corner 22. The inlets 82 and 84 may be located on either side of or in the bend present in the corners 16 and 22.

As stated, it is desirable to prevent water from entering the first and second manifolds 12 and 14 through the first and second conduits 58 and 60. Prevention of the presence of water in these areas protects the engine 80 and the catalysts 36 and 38. Although the injection of cooling water 28 and 30 into the system at the inlets 82 and 84 introduces water, the length of conduits 58 and 60 places the cooling water 28 and 30 at a location remote from the manifolds 12 and 14. Introduction of the cooling water 28 and 30 at a location remote from the manifolds 12 and 14 may prevent reversion in that the cooling water 28 and 30 will have to traverse a great length in order to contact and effect the catalysts 36 and 38 or the engine 80. In accordance with certain exemplary embodiments of the present invention, the cooling water 28 and 30 may be introduced at the inlets 82 and 84 a distance from 36 to 72 inches from their respective manifolds 12 and 14. It is to be understood, however, that cooling water 28 and 30 may be introduced at distances from the first and second manifolds 12 and 14 other than the ones previously mentioned in accordance with other embodiments. For example, the cooling water 28 and 30 may be introduced only 24 inches from the inlet of manifolds 12 and 14. The marine engine exhaust system 10 is designed so that the gases 18 and 24 travel some length of the conduits 58 and 60 without being mixed with any cooling water 28 and 30. The length of conduits 58 and 60 and conduit 62 if present also assists in keeping salt laden air remote from the catalysts 36 and 38 when the watercraft is in a salt water environment. This arrangement helps prevent salt build up on the catalysts 36 and 38 when the engine 80 is not operated to extend the life of the catalysts 36 and 38.

Figure 4:
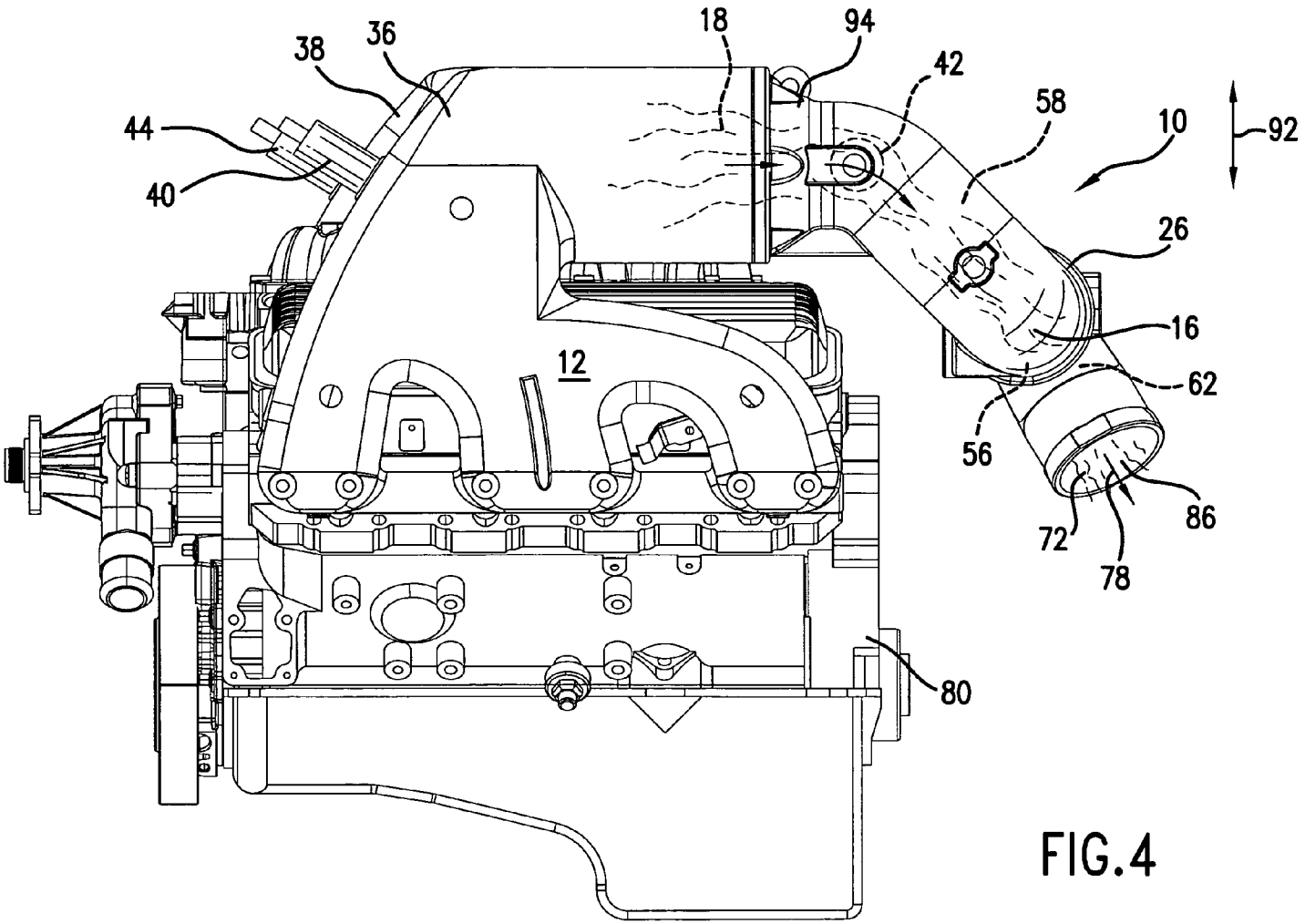
FIG. 4 is a side view of the marine engine exhaust system of FIG. 1.

The marine engine exhaust system 10 may also be designed with a downward routing that serves as a collection point for any errant water migration. FIG. 4 shows a side view of the marine engine exhaust system 10. The first gas 18 exits the manifold 12 and is transferred in the downstream direction into an inlet 94 of the first corner 16. In a similar manner, second gas 24 exits manifold 14 and is likewise transferred downstream through inlet 96 of the second corner 22. Inlets 94 and 96 are located above the crossover 26 in the vertical direction 92. The exhaust gases 18 and 24 are transferred downward in the vertical direction 92 as they travel through the first and second conduits 58 and 60 in the downstream direction. A low point 56 is present in the crossover 26. Water that forms through condensation in the first and second conduits 58 and 60, in addition to forming in other components of the marine engine exhaust system 10, may flow downward via gravity into the low point 56. Water can be collected at the low point 56 and prevented from damaging the catalysts 36 and 38 and the engine 80 as it will be located below the manifolds 12 and 14 in the vertical direction 92 and prevented from regressing upwards through the force of gravity. Once the engine 80 is started, pressure from the flow of the first and second gases 18 and 24 acts to force water collected in the low point 56 out of the system 10 through the outlet 86. The outlet 86 of the crossover 26 is oriented downward in the vertical direction 92 from the low point 56. As such, the gases 18 and 24 along with the cooling water 28 and 30 are directed downward in the vertical direction 92 through the length of the marine engine exhaust system 10. The downward design acts to channel water towards the outlet of the marine engine exhaust system 10 and away from the engine 80 and other components susceptible to failure through water engagement such as the catalysts 36 and 38 and associated oxygen sensors 40, 42, 44 and 46.

Condensation can be encouraged to develop at the crossover 26 and not at other points in the marine engine exhaust system 10. For example, the crossover 26 can be made of a metal, such as aluminum or steel, that is generally kept at a cooler temperature than the first and second manifolds 12 and 14 which are heated. Moisture flowing through the marine engine exhaust system 10 may condense on the cooler walls of the crossover 26 to thus develop condensation away from other areas of the system such as the catalysts 36 and 38. Although described as being metal, it is to be understood that the crossover 26 can be made of other types of materials in accordance with other exemplary embodiments. Further, other components such as the corners 16 and 18 can be made of metal or non-metal material in accordance with various embodiments.

It is to be understood that the low point 56 need not be the lowest point of the marine engine exhaust system 10 in the vertical direction 92. For example, the outlet 86 of the crossover 26 may be located vertically below the low point 56 in the vertical direction. However, the low point 56 is located below the inlets 94 and 96 in the vertical direction 92 in order to hinder the flow of water back up and into the manifolds 12 and 14. Although described as being designed in order to retain water formed through condensation, the low point 56 is capable of collecting and preventing water introduced in other manners into system 10 from damaging the engine 80 and catalysts 36 and 38. For example, water introduced into the first and second conduits 58 and 60 through wave action or reversion will likewise be hindered in flowing upwards into manifolds 12 and 14 by the presence of the low point 56. Although described as having the low point 56, it is to be understood that other exemplary embodiments of the present invention exist in which the low point 56 is not present. For example, the crossover 26 may be at the same height in the vertical direction 92 as the first and second corners 16 and 22 and inlets 92 and 94 in other exemplary embodiments.

Figure 5:
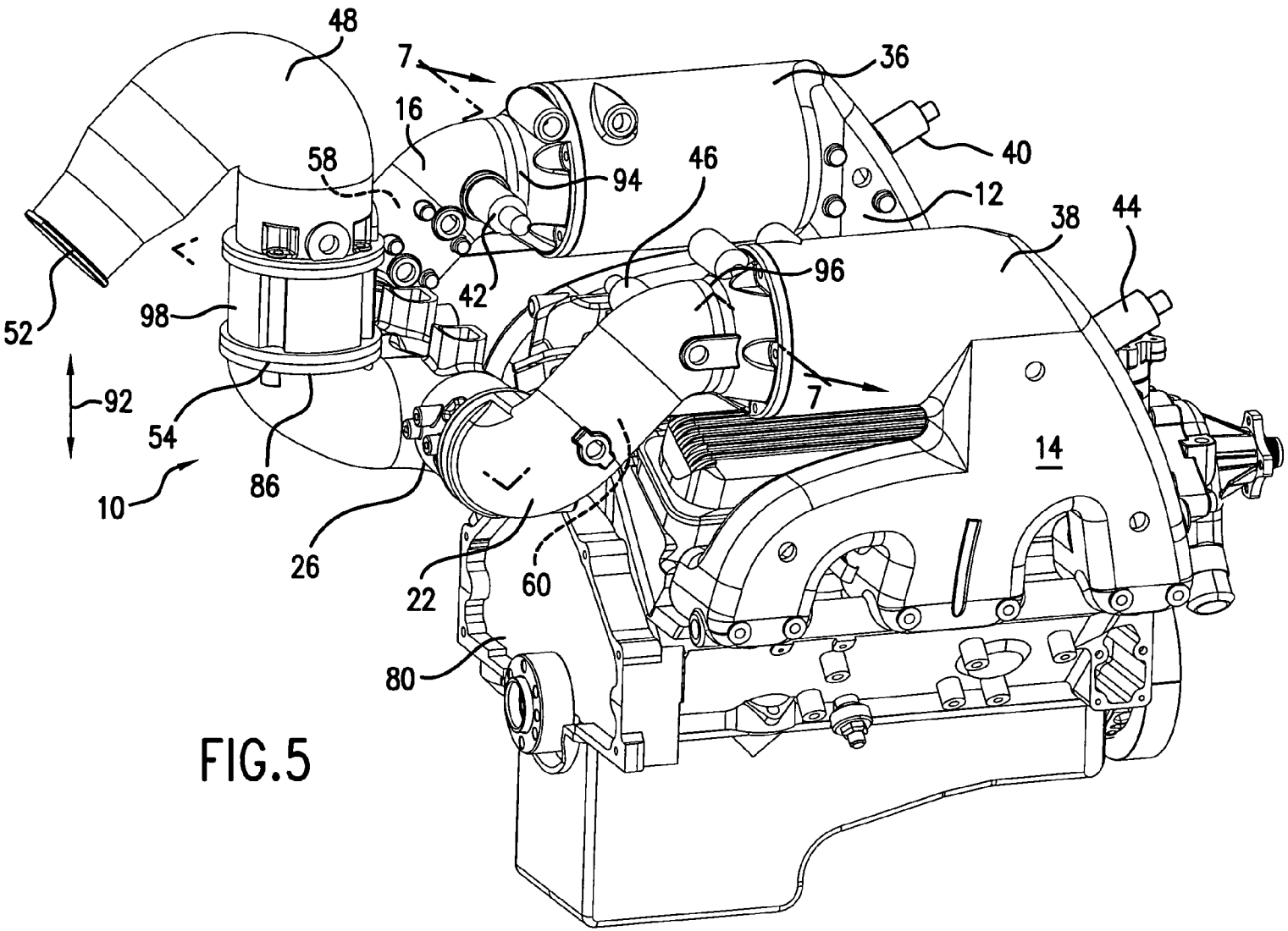
FIG. 5 is a perspective view of a marine engine exhaust system in accordance with one exemplary embodiment of the present invention.

An additional exemplary embodiment of the marine engine exhaust system 10 is shown in FIG. 5. The engine 80 onto which the marine engine exhaust system 10 is employed is a twin head eight cylinder engine. The first and second manifolds 12 and 14 along with the first and second corners 16 and 22 may be constructed as previously described with respect to the exemplary embodiment of FIG. 1 and a repeat of their possible design configurations is not necessary. Catalysts 36 and 38 along with associated oxygen sensors 40, 42, 44 and 46 may also be included as previously discussed above and need not be repeated here. The exemplary embodiment shown in FIG. 5 has a crossover 26 that is configured differently than the crossover 26 in the exemplary embodiment in FIG. 1. The first and second gases 18 and 24 can be transported through the crossover 26 in FIG. 5 and exit through an outlet 86 thereof into one or more risers 98. The risers 98 function so as to allow the first and second gases 18 and 24 to be transported upwards in the vertical direction 92. An elbow 48 is connected to the risers 98 and discharges the exhaust gases 18 and 24 from a tip 52 into the body of water in which the watercraft is deployed or into a hose 88 (not shown).

Figure 6:
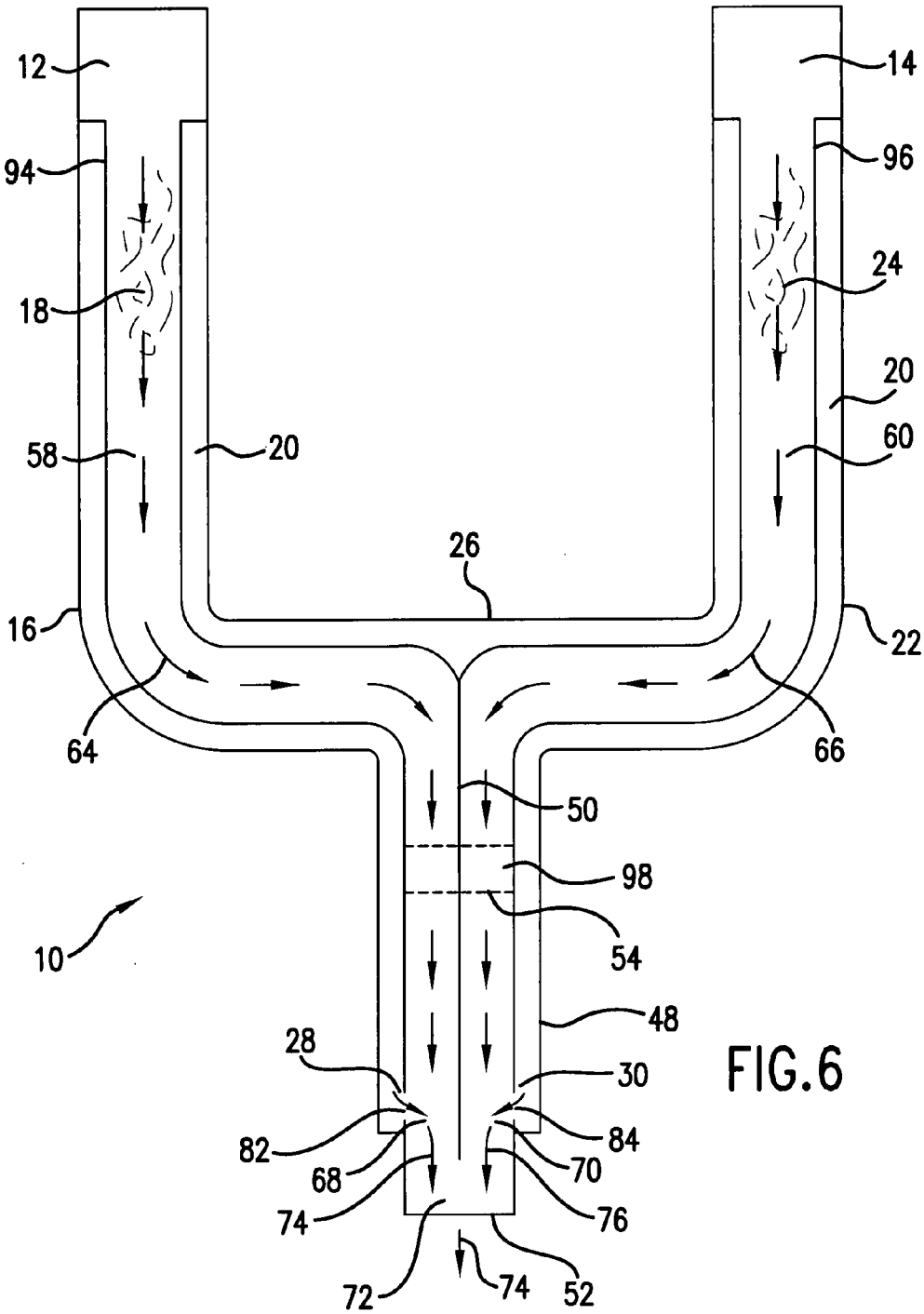
FIG. 6 is a schematic circuit view of the marine engine exhaust system of FIG. 5.

FIG. 6 is a schematic circuit diagram of the marine engine exhaust system 10 of FIG. 5. First gas 18 exits the first manifold 12 and enters the first conduit 58. In a similar manner, second gas 24 exits the second manifold 14 and enters second conduit 60. The gases 18 and 24 are kept separate from cooling water along at least a portion of the length of the first and second conduits 58 and 60. In fact, the gases 18 and 24 are not combined with cooling water or with one another upon entering the crossover 26. The first gas 18 flows in direction 64, and the second gas 24 flows in direction 66. A wall 50 is located inside of crossover 26 in order to keep the first gas 18 separate from the second gas 24. As such, the first conduit 58 and second conduit 60 do not merge with one another in the crossover 26.

The first gas 18 and second gas 24 exit the outlet 86 of crossover 26 and enter the riser 98. Riser 98 also includes the wall 50 which maintains the gases 18 and 24 separate through their transfer through the riser 98. If additional risers 98 are stacked on top of one another to achieve a desired height the additional risers 98 can also include the wall 50 to keep the gases 18 and 24 separate through their transfer length. The riser 98 is connected to an elbow inlet 54 of the elbow 48. The elbow 48 includes the wall 50 throughout a portion of its length which acts to maintain the gases 18 and 24 separate throughout this portion of the elbow 48. An inlet 82 through which cooling water 28 is dispensed is in communication with the first conduit 58. Inlet 84 through which cooling water 30 can be transferred is in communication with the second conduit 60. Cooling water 28 is merged with the first gas 18 to form a combined stream 68 flowing in direction 74 as shown in FIG. 6. Also, cooling water 30 is mixed with the second gas 24 to form combined stream 70 that moves in direction 76. At this point, the wall 50 acts to maintain the gases 18 and 24 separate from one another. As such, cooling water 28 and 30 is mixed with the gases 18 and 24 before the gases 18 and 24 are mixed with one another. The addition of cooling water 28 and 30 before the gases 18 and 24 are merged with one another acts to cool the individual gas streams 18 and 24 and reduce backpressure on the engine 80 as previously discussed.

The combined streams 68 and 70 can be merged with one another to form a combined stream 72 as shown in FIG. 6. Combined stream 72 will flow in direction 78 and exit the elbow 54 from the tip 52. The gases 18 and 24 can be maintained separate from the cooling water 28 and 30 until the tip 52 of the elbow 48 in order to maximize the distance between the introduction of the cooling water 28 and 30 into the conduits 58 and 60 and the manifolds 12 and 14. This configuration helps to keep the cooling water 28 and 30 remote from the catalysts 36 and 38 and associated oxygen sensors 40, 42, 44 and 46 and the engine 80 to prevent damage thereto. In this configuration, water will have to transfer through reversion a great distance thus reducing the odds of water damaging the aforementioned components.

Although described and shown as mixing at the tip 52, the combined streams 68 and 70 need not mix at this location to form the combined stream 72 in other embodiments. For example, the elbow 48 may be configured so that the combined streams 68 and 70 are sprayed from the tip 52 to an area outside of the watercraft or into a hose 88 (not shown). In this regard, the combined streams 68 and 70 may either not merge with one another to form the combined stream 72 or may do so at a location away from the elbow 54.

Figure 7:
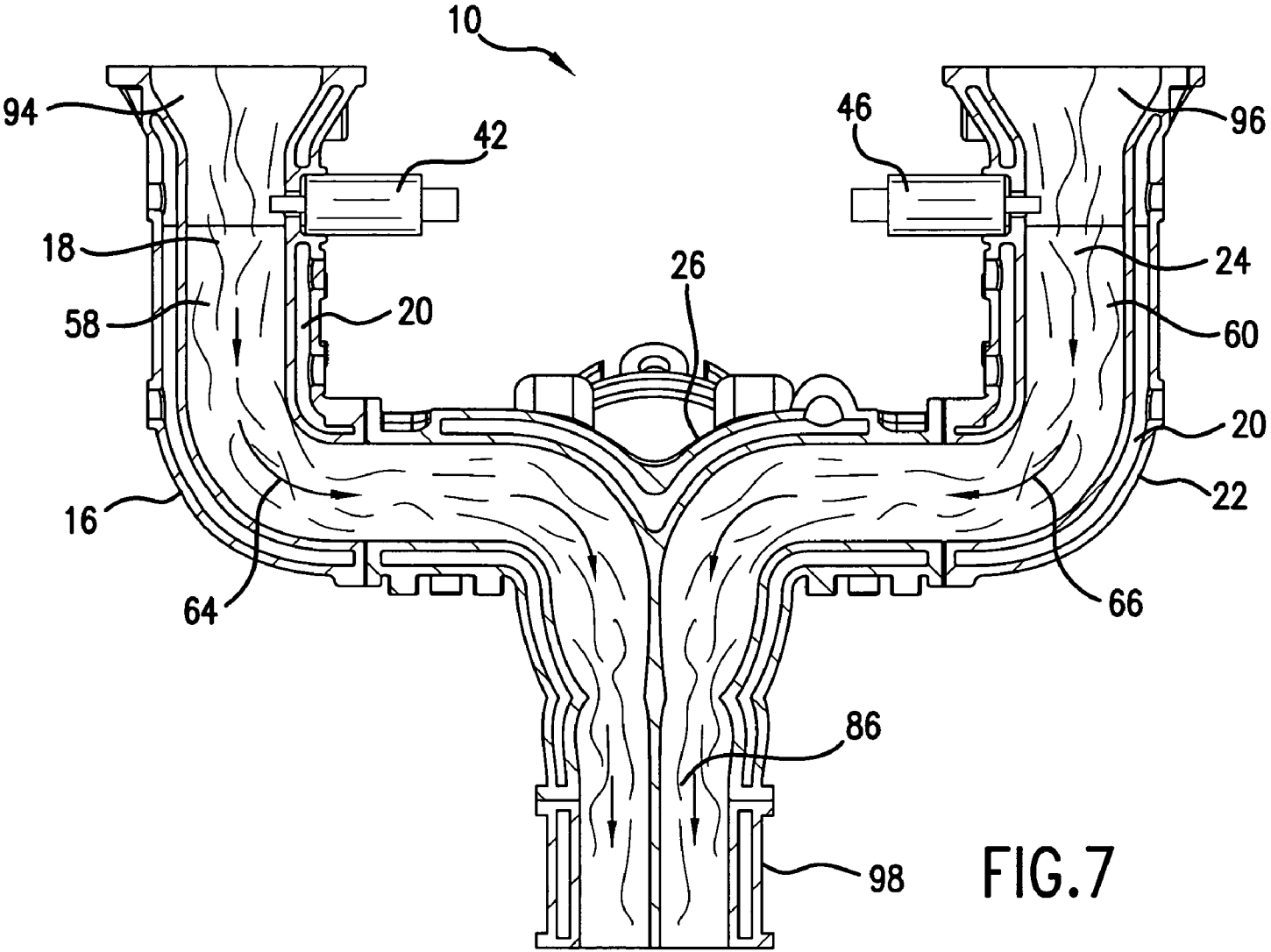
FIG. 7 is a cross-sectional view showing the corners, crossover and riser of the marine engine exhaust system of FIG. 5.

FIG. 7 is a cross-sectional view of the corners 16 and 22, crossover 26 and riser 98. Cooling fluid 20 may be used to cool these components in a manner as previously described. In this regard, the cooling fluid 20 may be either antifreeze or water and can draw heat away from the first and second gas 18 and 24 in order to cool the marine engine exhaust system 10. Raw water may be run through the corners 16 and 22, crossover 26 and riser 98 or antifreeze may be used in a closed cooling system as previously discussed. The introduction of cooling water 28 and 30 into the gases 18 and 24 in elbow 48 may be either the cooling fluid 20 passed through the various components or may be heated water from a heat exchanger used when the cooling fluid 20 is antifreeze. Although shown as cooling substantially along the entire length of conduits 58 and 60, it is to be understood that the cooling fluid 20 may only be arranged to cool less than substantially all of the length of conduits 58 and 60 in accordance with other exemplary embodiments.

Figure 8:
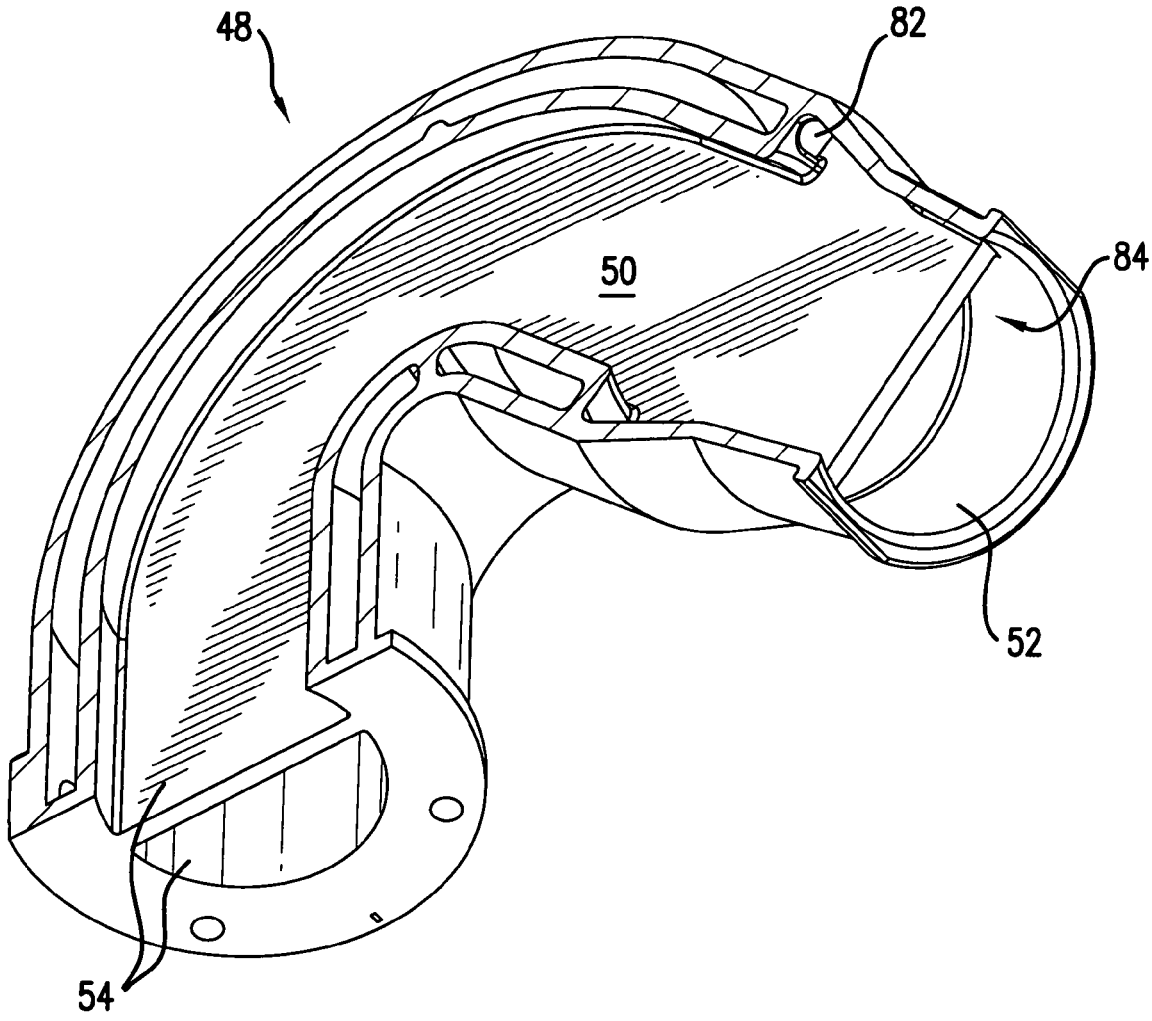
FIG. 8 is a cross-sectional view of the elbow of the marine engine exhaust system of FIG. 5.

A perspective, cross-sectional view of the elbow 48 is shown in FIG. 8. The wall 50 is shown as extending from the elbow inlet 54 to a position proximate to tip 52. A jacket may surround the first and second conduits 58 and 60 extend through the elbow 48 in order to provide cooling. Cooling fluid 20 that may be cooling water or antifreeze can be transferred through the jacket of the elbow 48. The exemplary embodiment shown in FIG. 8 includes cooling water passed through the jacket and into the conduits 60 and 62 through the inlets 82 and 84. The inlets 82 and 84 may be located at the top of the conduits 58 and 60 so that the cooling water 28 and 30 may be dispensed through a larger amount of the first and second gases 18 and 24 to increase the amount of cooling.

Figure 9:
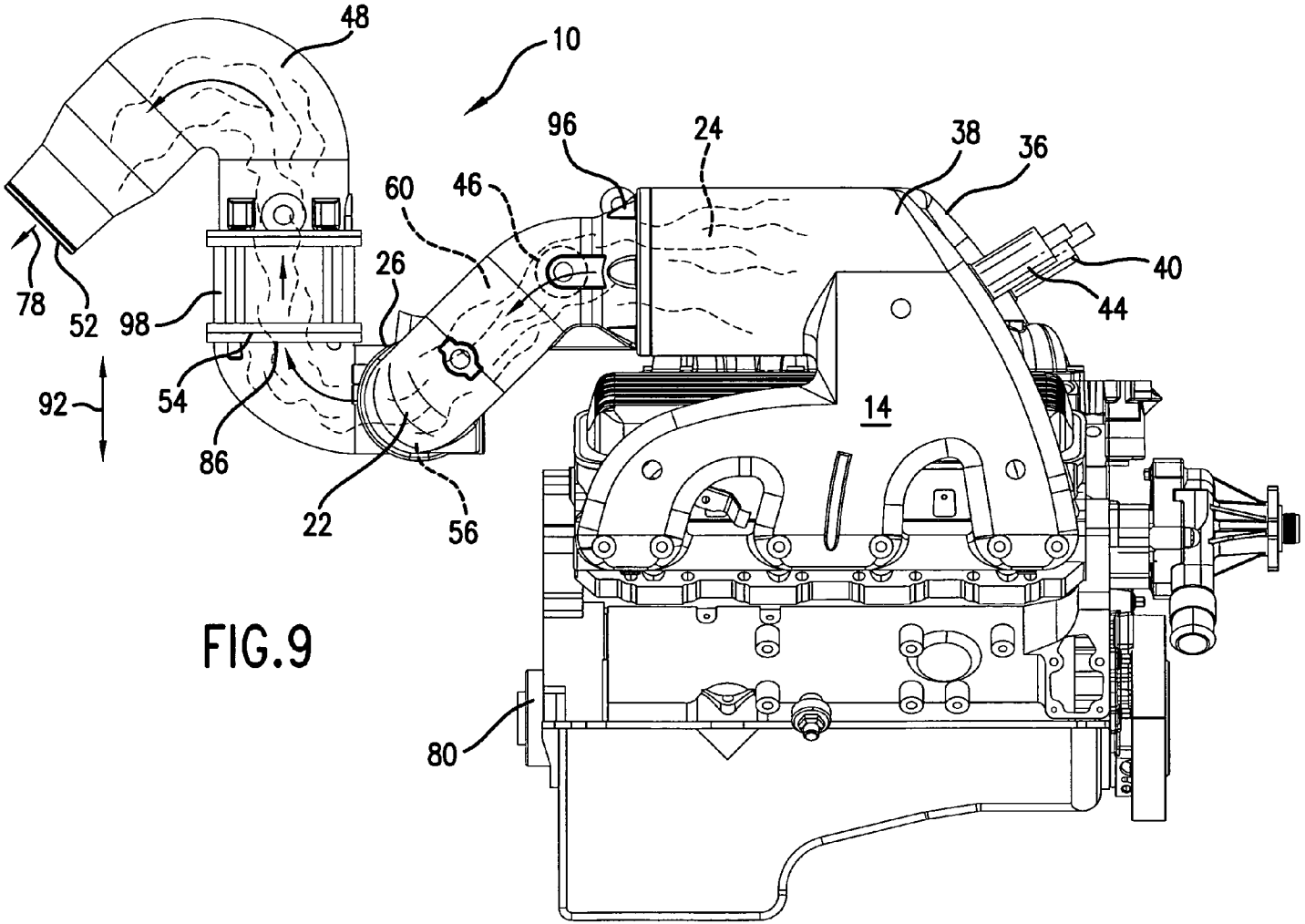
FIG. 9 is a side view of the marine engine exhaust system of FIG. 5.

A side view of the marine engine exhaust system 10 is shown in FIG. 9. The system 10 can be designed with a down swept configuration so that the first and second gases 18 and 24 are transferred through the first and second conduits 58 and 60 downward in the vertical direction 92. The first and second conduits 58 and 60 define a low point 56 in the crossover 26. It is to be understood, however, that certain portions of the elbow 48 may be located below the low point 56 in accordance with certain exemplary embodiments. These features of the system 10, such as the fact that the crossover 26 may have a metal inner surface to promote condensation, are similar to those discussed above with respect to the exemplary embodiment of FIG. 1 and need not be repeated here.

Figure 10:
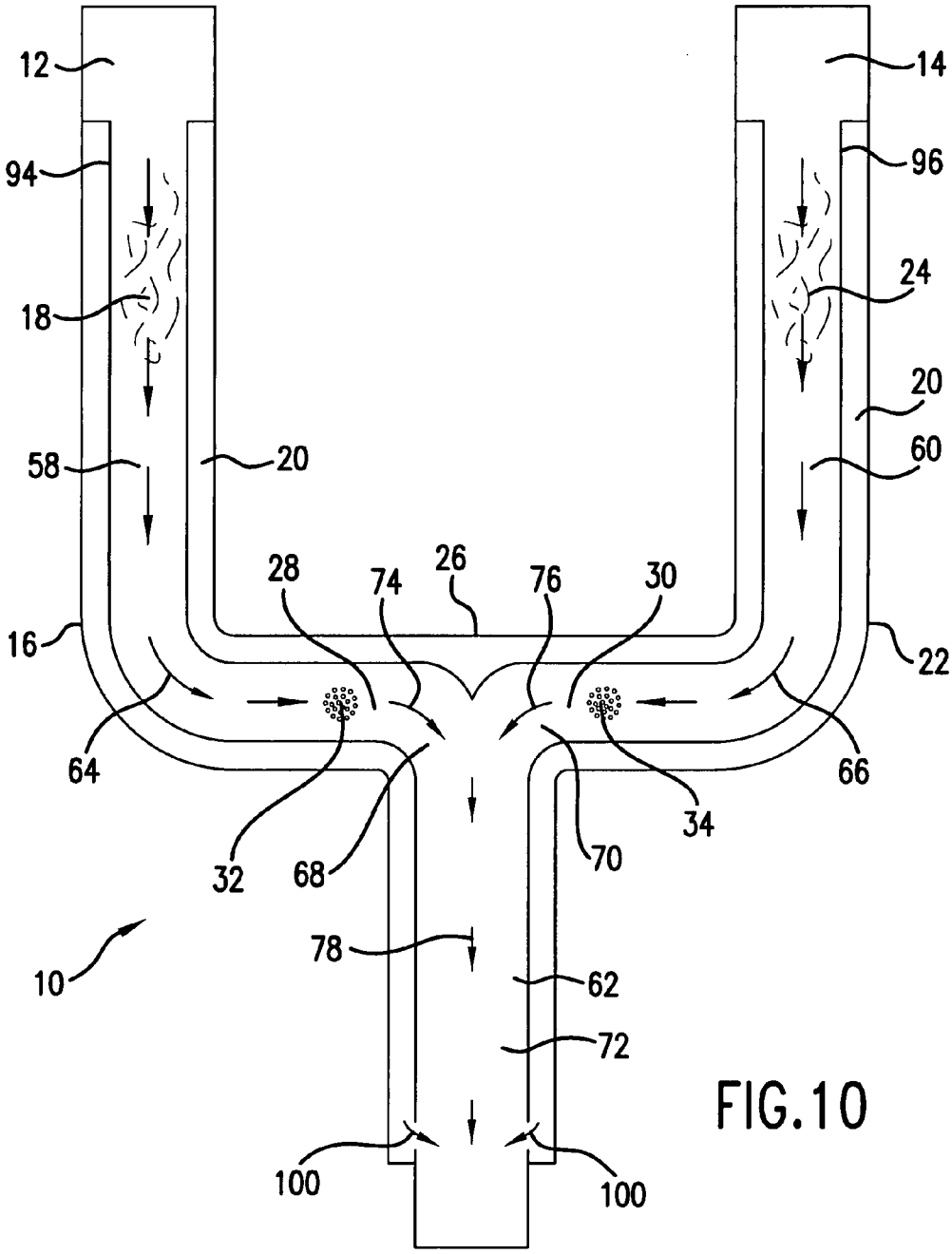
FIG. 10 is a schematic circuit view of a marine engine exhaust system in accordance with one exemplary embodiment of the present invention.

A schematic view of an additional exemplary embodiment of the marine engine exhaust system 10 is shown in FIG. 10. Here, the system 10 is arranged in a manner similar to, although not exact to, previously discussed embodiments. As such, a complete description of various components of the system 10 is not needed as they may be arranged as described above. The system 10 includes a mist component 32 in communication with the first gas 18 in the first conduit 58. Another mist component 34 is present and is in communication with the second gas 24 in the second conduit 60. Mist component 32 functions so as to allow cooling water 28 to be injected into the first gas 18 in a mist form. The mist component 32 may be a series of small apertures located through a wall forming the first conduit 58. Alternatively, the mist component 32 may be an item such as a nozzle that allows cooling water 28 to be dispensed therefrom in a mist form. The misted cooling water 28 functions so as to condense and cool the first gas 18 so as to relieve backpressure on the engine 80. The misted cooling water 28 is injected into the first gas 18 before the first gas 18 and the second gas 24 merge with one another.

The mist component 34 associated with the second conduit 60 can be arranged in a manner similar to the mist component 32 as previously described. Mist component 34 functions so as to inject misted cooling water 30 into the second gas 24 to cool and condense the second gas 24 to relieve backpressure. The misted cooling water 30 can be introduced into the second gas 24 before the first and second gases 18 and 24 merge with one another. Other arrangements are possible in which only one of the gases 18 or 24 are injected with misted cooling water 28 or 30 and the other gas 18 or 24 is either not treated with cooling water 28 or 30 or has cooling water 28 or 30 injected as a stream therein. In accordance with certain exemplary embodiments the misted cooling water 28 and 30 is injected continuously while the engine 80 runs and gases 18 and 24 flow through conduits 58 and 60.

Misted cooling water 28 and 30 forms combined streams 68 and 70. The combined streams 68 and 70 merge into one another to form combined stream 72 that is transferred through third conduit 62. Remaining cooling water 100 in the system 10 can be merged with the combined stream 72 as indicated and dispensed from the outlet 86. The misted cooling water 28 and 30 functions so as to cool and condense the gas streams 18 and 24 throughout a portion of the length of the conduits 60, 62 and 64 to reduce the amount of backpressure on engine 80. The exemplary embodiment in FIG. 10 may also include features such as the low point 56 in the crossover 26 as previously discussed with regard to other versions. Additionally, an elbow 48 with associated risers 98 if desired may be incorporated into the exhaust system 10 shown in FIG. 10. Further, the mist components 32 and 34 can be included in other previously described embodiments to achieve additional utility of the marine engine exhaust system 10.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A marine engine exhaust system, comprising:

a first manifold on a side of an engine;

a second manifold on a side of the engine opposite the side of the engine that has the first manifold;

a first conduit in fluid communication with said first manifold such that a first gas exiting said first manifold is transferred into said first conduit, wherein said first conduit has a bend that changes the downstream direction of flow of the first gas in the direction towards the side of the engine having said second manifold, wherein the first gas is isolated from cooling water through said bend of said first conduit;

a second conduit in fluid communication with said second manifold such that a second gas exiting said second manifold is transferred into said second conduit, wherein the second gas is isolated from the cooling water at least part way through said second conduit; and a third conduit in fluid communication with said first conduit and said second conduit such that the first gas exiting said first conduit is transferred into said third conduit and such that the second gas exiting said second conduit is transferred into said third conduit, wherein said third conduit is configured such that the first gas and the second gas merge therein, and wherein the cooling water is merged with at least one of the first gas and the second gas before the first gas and the second gas merge in said third conduit.

2. The marine engine exhaust system as set forth in claim 1, wherein the cooling water is merged with both the first gas and with the second gas before the first gas and the second gas merge in said third conduit.

3. The marine engine exhaust system as set forth in claim 1, wherein the cooling water is injected in a mist form when merged with at least one of the first gas and the second gas before the first gas and the second gas merge in said third conduit.

4. The marine engine exhaust system as set forth in claim 1, wherein said first manifold has a first catalyst for treating the first gas, and wherein said second manifold has a second catalyst for treating the second gas.

5. The marine engine exhaust system as set forth in claim 4, wherein an oxygen sensor that senses the first gas is located downstream from said first catalyst in the direction of flow of the first gas through said first manifold and said first conduit, wherein said first manifold has an oxygen sensor that senses the first gas and is located upstream from said first catalyst in the direction of flow of the first gas through said first manifold, wherein an oxygen sensor that senses the second gas is located downstream from said second catalyst in the direction of flow of the second gas through said second manifold and said second conduit, wherein said second manifold has an oxygen sensor that senses the second gas and is located upstream from said second catalyst in the direction of flow of the second gas through said second manifold.

6. The marine engine exhaust system as set forth in claim 1, wherein said first conduit and said second conduit are oriented such that the first gas and the second gas flow downward in the downstream direction from said first manifold and said second manifold to said third conduit such that said third conduit is at a low point for retaining condensation.

7. The marine engine exhaust system as set forth in claim 1, wherein said third conduit, said first conduit, and said second conduit are configured to transfer a cooling fluid selected from the group consisting of cooling water and antifreeze in order to cool the first gas and the second gas.

8. A marine engine exhaust system, comprising:

a first manifold on a side of an engine;

a second manifold on a side of the engine opposite the side of the engine that has the first manifold;

a first conduit in fluid communication with said first manifold such that a first gas exiting said first manifold is transferred into said first conduit, wherein said first conduit has a bend that changes the downstream direction of flow of the first gas in the direction towards the side of the engine having said second manifold, wherein the first gas is isolated from cooling water through said bend of said first conduit;

a second conduit in fluid communication with said second manifold such that a second gas exiting said second manifold is transferred into said second conduit, wherein the second gas is isolated from the cooling water through said second conduit;

a third conduit in fluid communication with said first conduit and said second conduit such that the first gas exiting said first conduit is transferred into said third conduit and such that the second gas exiting said second conduit is transferred into said third conduit, wherein said third conduit is configured such that the first gas and the second gas are maintained separate therethrough; and an elbow in fluid communication with said third conduit such that after the first gas exits said third conduit the first gas is transferred into said elbow and such that after the second gas exits said third conduit the second gas is transferred into said elbow, wherein said elbow is configured to allow the first gas and the second gas to merge with one another, wherein the cooling water is merged with at least one of the first gas and the second gas before the first gas and the second gas merge in said elbow.

9. The marine engine exhaust system as set forth in claim 8, wherein the cooling water is merged with the first gas and with the second gas before the first gas and the second gas merge in said elbow.

10. The marine engine exhaust system as set forth in claim 9, wherein said elbow has a wall that keeps the first gas and the second gas separate throughout a majority of the transfer length through said elbow, and wherein the merged first gas and cooling water is merged with the merged second gas and cooling water at a tip of said elbow.

11. The marine engine exhaust system as set forth in claim 8, wherein said first manifold has a first catalyst for treating the first gas, and wherein said second manifold has a second catalyst for treating the second gas.

12. The marine engine exhaust system as set forth in claim 11, wherein an oxygen sensor that senses the first gas is located downstream from said first catalyst in the direction of flow of the first gas through said first manifold and said first conduit, wherein said first manifold has an oxygen sensor that senses the first gas and is located upstream from said first catalyst in the direction of flow of the first gas through said first manifold, wherein an oxygen sensor that senses the second gas is located downstream from said second catalyst in the direction of flow of the second gas through said second manifold and said second conduit, wherein said second manifold has an oxygen sensor that senses the second gas and is located upstream from said second catalyst in the direction of flow of the second gas through said second manifold.

13. The marine engine exhaust system as set forth in claim 8, wherein said first conduit and said second conduit are oriented such that the first gas and the second gas flow downward in the downstream direction from said first manifold and said second manifold to said third conduit, and wherein said elbow is oriented with respect to said third conduit such that the first gas and the second gas flow upwards in the downstream direction from said third conduit into said elbow through an elbow inlet, wherein said third conduit is at a low point for retaining condensation.

14. The marine engine exhaust system as set forth in claim 8, wherein said third conduit, said first conduit, and said second conduit are configured to transfer a cooling fluid selected from the group consisting of cooling water and antifreeze in order to cool the first gas and the second gas.

15. The marine engine exhaust system as set forth in claim 8, further comprising at least one riser located between said third conduit and said elbow so as to place said third conduit into fluid communication with said elbow, wherein the first gas and the second gas exiting said third conduit are transferred into said riser and move vertically upwards and are transferred from said riser into said elbow.

16. A marine engine exhaust system, comprising:

a first manifold;

a second manifold;

a first conduit in fluid communication with said first manifold such that a first gas exiting said first manifold is transferred into said first conduit, wherein the first gas is isolated from cooling water through at least a portion of said first conduit;

a second conduit in fluid communication with said second manifold such that a second gas exiting said second manifold is transferred into said second conduit, wherein the second gas is isolated from the cooling water through at least a portion of said second conduit; and a third conduit in fluid communication with said first conduit and said second conduit such that the first gas exiting said first conduit and the second gas exiting said second conduit merge in said third conduit;

wherein the cooling water is merged with the first gas in said first conduit before the first gas and the second gas merge in said third conduit, wherein the cooling water is merged with the second gas in said second conduit before the first gas and the second gas merge in said third conduit, and wherein subsequently the combined first gas and the cooling water is intentionally merged with the combined second gas and the cooling water to form a combined stream of the combined first gas and the cooling water and the combined second gas and the cooling water.

17. The marine engine exhaust system as set forth in claim 16, wherein the cooling water is injected in a mist form when merged with at least one of the first gas and the second gas before the first gas and the second gas merge in said third conduit.

18. The marine engine exhaust system as set forth in claim 16, wherein said first manifold has a first catalyst for treating the first gas, and wherein said second manifold has a second catalyst for treating the second gas, wherein an oxygen sensor that senses the first gas is located downstream from said first catalyst in the direction of flow of the first gas through said first manifold and said first conduit, wherein said first manifold has an oxygen sensor that senses the first gas and is located upstream from said first catalyst in the direction of flow of the first gas through said first manifold, wherein an oxygen sensor that senses the second gas is located downstream from said second catalyst in the direction of flow of the second gas through said second manifold and said second conduit, wherein said second manifold has an oxygen sensor that senses the second gas and is located upstream from said second catalyst in the direction of flow of the second gas through said second manifold.

19. The marine engine exhaust system as set forth in claim 16, wherein said first conduit has a bend that changes the downstream direction of flow of the first gas in a direction towards a side of an engine having said second manifold, wherein the first gas is isolated from the cooling water through said bend of said first conduit, wherein said second conduit has a bend that changes the downstream direction of flow of the second gas in a direction towards a side of the engine having said first manifold, wherein the second gas is isolated from the cooling water through said bend of said second conduit.

20. A marine engine exhaust system, comprising:

a first manifold on a side of an engine;

a second manifold on a side of the engine opposite the side of the engine that has the first manifold;

a first conduit in fluid communication with said first manifold such that a first gas exiting said first manifold is transferred into said first conduit, wherein said first conduit has a bend that changes the downstream direction of flow of the first gas in a direction towards the side of the engine having said second manifold, wherein the first gas is isolated from the cooling water through said bend of said first conduit;

a second conduit in fluid communication with said second manifold such that a second gas exiting said second manifold is transferred into said second conduit, wherein said second conduit has a bend that changes the downstream direction of flow of the second gas in a direction towards the side of the engine having said first manifold, wherein the second gas is isolated from the cooling water through said bend of said second conduit; and a third conduit in fluid communication with said first conduit and said second conduit such that the first gas exiting said first conduit and second gas exiting said second conduit merge in said third conduit, wherein the cooling water is merged with the first gas before the first gas and the second gas merge in said third conduit, wherein the cooling water is merged with the second gas before the first gas and the second gas merge in said third conduit, and wherein subsequently the combined first gas and the cooling water is intentionally merged with the combined second gas and the cooling water to form a combined stream of the combined first gas and the cooling water and the combined second gas and the cooling water;

wherein said first conduit and said second conduit are oriented such that the first gas and the second gas flow downward from said first manifold and said second manifold in the downstream direction to said third conduit such that said third conduit is at a low point for retaining condensation.

21. The marine engine exhaust system as set forth in claim 20, wherein the cooling water is merged with at least one of the first gas in said first conduit and the second gas in said second conduit before the first gas and the second gas merge in said third conduit, wherein the first gas is isolated from the cooling water through at least a portion of said first conduit, wherein the second gas is isolated from the cooling water through at least a portion of said second conduit.

22. The marine engine exhaust system as set forth in claim 20, wherein at least a portion of said third conduit is located in an elbow, and wherein said elbow is oriented with respect to said third conduit such that the first gas and the second gas flow upwards in the downstream direction from said third conduit into said elbow through an elbow inlet.

23. The marine engine exhaust system as set forth in claim 20, wherein said first manifold has a first catalyst for treating the first gas, and wherein said second manifold has a second catalyst for treating the second gas.

* * * * *

UNITED STATES PATENT AND TRADEMARK OFFICE

CERTIFICATE OF CORRECTION

PATENT NO. : 7,803,026 B2
APPLICATION NO. : 11/729671
DATED : September 28, 2010
INVENTOR(S) : Mark C. McKinney It is certified that error appears in the above-identified patent and that said Letters Patent is hereby corrected as shown below:

In claim 20 at col. 15 line 33, the word "the" should be deleted.
In claim 20 at col. 16 line 3, the phrase "and second" should read --and the second--.

Signed and Sealed this

Seventh Day of December, 2010

David J. Kappos

David J. Kappos
*Director of the United States Patent and Trademark Office*